United States Patent [19]

Capasso

[11] Patent Number: 4,830,118

[45] **Date of Patent: * May 16, 1989**

[54] SHUT-OFF DEVICE FOR A SPRINKLER ASSEMBLY

[75] Inventor: Vincent J. Capasso, Lansdale, Pa.

[73] Assignee: Fire Sprinkler Specialties, Inc., Chalfont, Pa.

[ * ] Notice: The portion of the term of this patent subsequent to Jun. 30, 2004 has been disclaimed.

[21] Appl. No.: 137,619

[22] Filed: Dec. 24, 1987

[51] Int. Cl.[4] ..... A62C 37/10

[52] U.S. Cl. ..... 169/90; 169/37; 169/57

[58] Field of Search ..... 169/90, 57, 37, 38, 169/41; 137/382.5

[56] References Cited

U.S. PATENT DOCUMENTS 4,676,320 6/1987 Capasso ..... 169/90

*Primary Examiner*—Sherman D. Basinger
*Assistant Examiner*—Thomas J. Brahan
*Attorney, Agent, or Firm*—Joseph W. Molasky & Assocs.

[57] ABSTRACT

A device for terminating the flow of fire-extinguishing fluid from an activated sprinkler head of the pendent and sidewall types. A cavity within the device receives the sprinkler head and a protuberance within said cavity engages the valve assembly and returns the shut-off valve to the fluid-emitting conduit. Biased apertures within the sidewalls engage the sprinkler head flange and provide a locking means. The device is constructed from thermoplastic resins which melt and allow the device to become reactivated when ambient temperatures reach critical levels.

9 Claims, 4 Drawing Sheets

FIG. 4
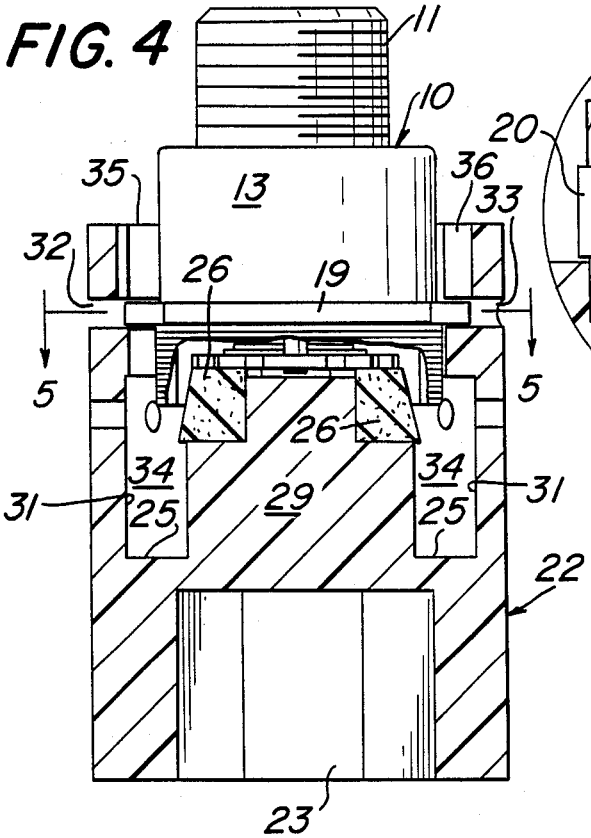
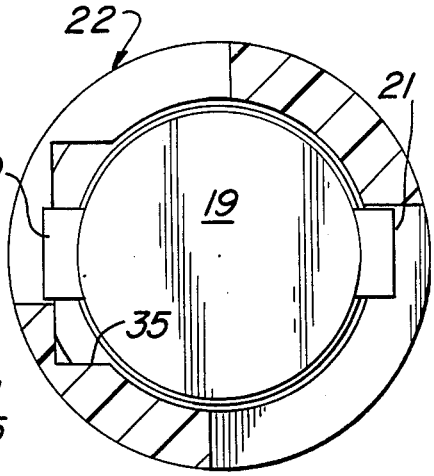
FIG. 5
FIG. 6
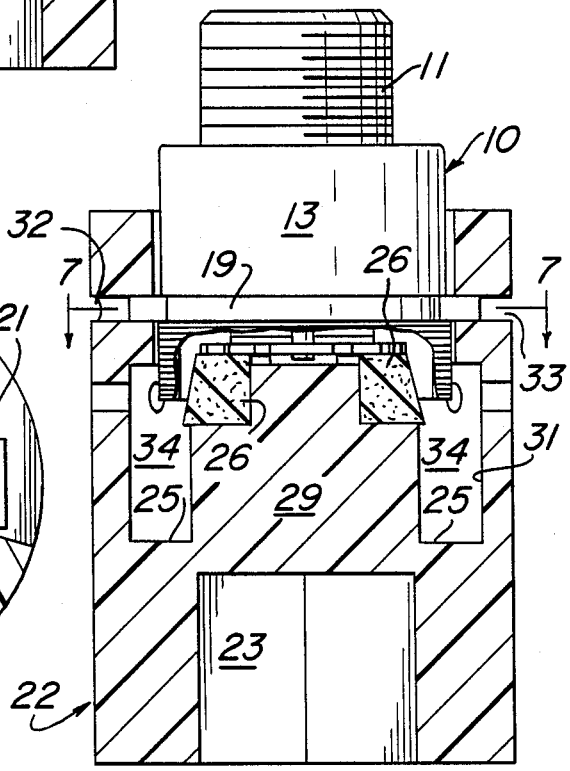
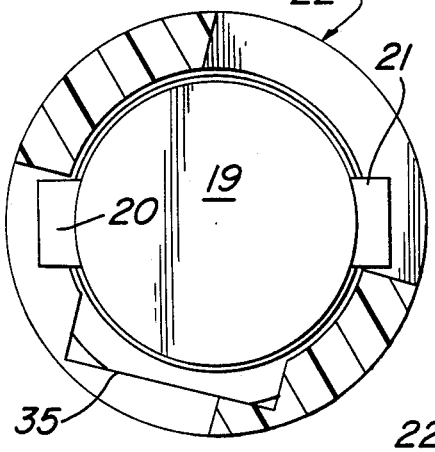
FIG. 7

FIG. 11
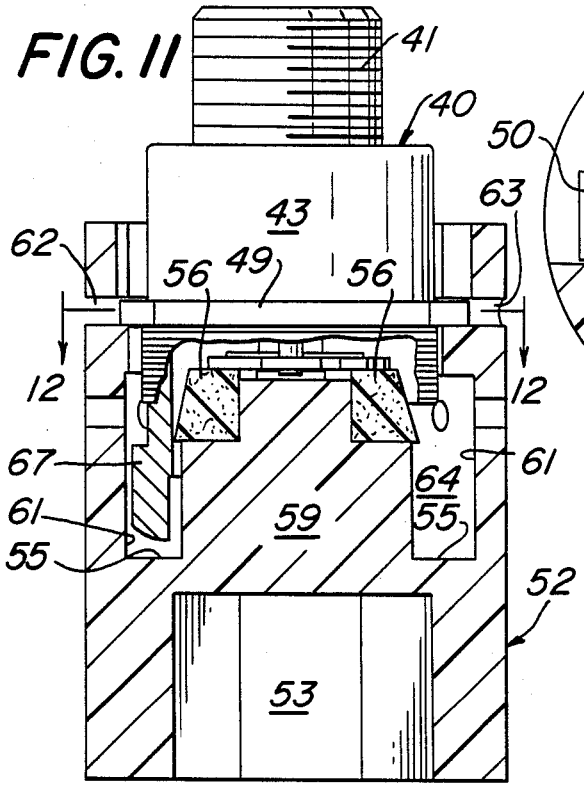
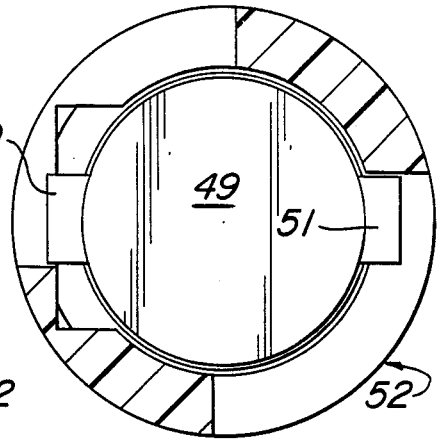
FIG. 12
FIG. 13
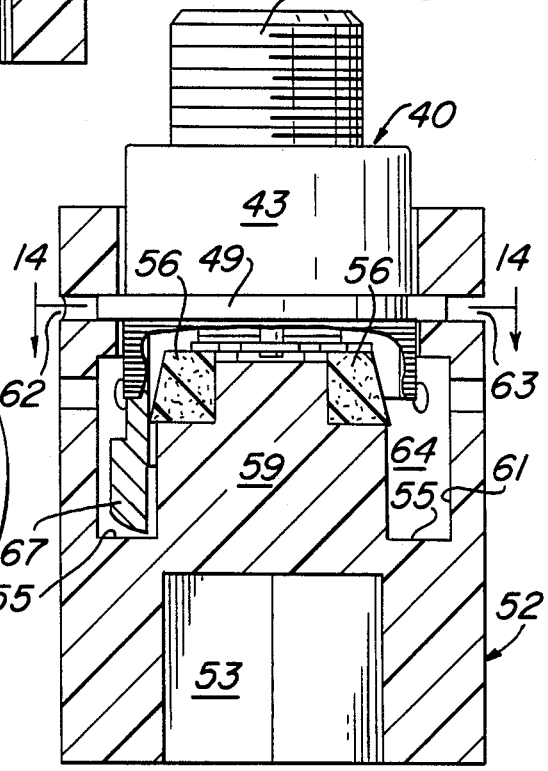
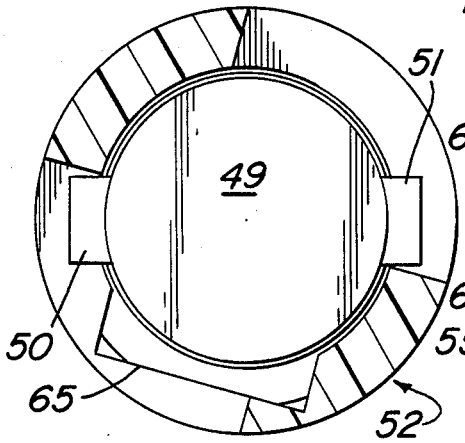
FIG. 14

SHUT-OFF DEVICE FOR A SPRINKLER ASSEMBLY

This invention relates to a shut-off device for a sprinkler head equipped with a bifurcated flange.

The device consists essentially of a hollow cylindrical body which can be impressed onto an activated sprinkler head to terminate fluid flow by returning the sprinkler shut-off valve to its fluid-conveying orifice.

Once fluid flow has been terminated the device may be locked onto the sprinkler assembly by a frictional engagement and it may remain in place in a locked mode without impairing the ability of the sprinkler to perform in its intended manner. This latter feature is made possible by virtue of the compositions used to construct the present device which melt and separate from the sprinkler head when ambient temperatures reach critical levels.

BACKGROUND

Sprinklers connected to gravity-fed or pressure-supplied water sources are able to discharge fire-extinguishing fluids at rates which can flood a building within a relatively short period of time. Accordingly, once a fire has been brought under control the sprinkler system must be promptly inactivated in order to avoid unnecessary water damage.

Unfortunately, most of the devices which are now available for closing down an activated sprinkler head are awkward to install and they require the application of such force that damage to the sprinkler head often occurs.

Accordingly, there is a need for a safe and effective means by which to avoid the damage which can result from a runaway sprinkler.

In U.S. Pat. No. 2,666,670, Vincent McGraw describes a closure device which installs easily and snaps away from the sprinkler head when the system is activated. Unfortunately, this snap-away device has application only on dry sprinkler heads, that is, systems in which the heads do not contain a supply of fire-extinguishing fluid per se but which rely, instead, upon a water reservoir maintained at a remote source. The McGraw device has no application to wet sprinklers which contain within the head a supply of water for immediate discharge.

In U.S. Pat. No. 3,223,171, Walter DeGroot describes a closure plug comprised of telescoping members which are spring loaded. The spring has a compressive force which is at least equal to the force exerted by the water in the supply line to ensure that the plug will not be rejected. This plug is installed by the use of a mounting pole equipped with a triggering mechanism.

The DeGroot plug is neither inexpensive to manufacture or practical in its application because, in time, the spring assembly corrodes, loses its resiliency and becomes inoperable. Moreover, the inserted plug remains fixed and, as a consequence, the system cannot be reactivated until the plug is removed by hand.

From the foregoing it is obvious that a need remains for a closure device which can be used to terminate the flow of water from an activated sprinkler head in an effective, safe, convenient and inexpensive manner.

Moreover, there is a need for a closure device which can be allowed to remain on a sprinkler head in an inconspicuous manner and which does not require manual removal.

The present invention fills these needs by providing a closure device which can be manufactured inexpensively and installed rapidly without difficulty.

THE INVENTION

It is an object of this invention to provide a shutoff device for terminating the flow of fluid from an activated overhead sprinkler in a cost effective manner with a modicum of effort.

More specifically, it is an object of this invention to provide a shut-off device which can be locked onto an activated sprinkler head and secure the device against inadvertent discharge.

Still another object is to provide a shut-off device which can be locked onto a sprinkler head and left unattended in a locked mode without compromising the ability of the sprinkler to function in its intended manner.

These and other objects are achieved by providing an integrally formed shut-off device which can be manufactured at low cost and installed easily and rapidly in a safe and effective manner.

The present invention provides means for terminating fluid flow in sprinkler heads of the pendent and sidewall type, that is, sprinkler heads which contain either a baffle plate equipped with a plurality of horizontal vanes for distributing fluid in a uniform pattern in all directions or a baffle plate equipped with horizontally extending fingers and a vertically disposed sidewall for impelling fluid in one direction only. These sprinkler heads differ in their water distributing means but their respective assemblies have in common an identical bifurcated flange member and it is this feature which allows the present device to be installed on both types of sprinklers with equal facility.

Structurally, the present device consists of a hollow cylindrical body equipped at one end with a contoured orifice for receiving the bifurcated flange of a sprinkler head. Extending downwardly from said orifice are continuous sidewall which form a cavity into which the valve assembly, flange and housing of said sprinkler may be inserted.

Centrally disposed within said cavity and extending upwardly from the cavity base is a circular projection which forms, together with the cavity sidewalls, a circular space or cirque for receiving the deflector of a sidewall type sprinkler. Also adjoined to this projection member at its topmost segment is a flat tubular seat for engaging the baffle plate of a sprinkler head when the device is fully installed.

The present device is utilized by positioning the contoured cavity beneath an activated sprinkler head in such manner as to place its cutout segments into alignment with the projection members of the bifurcated flange. Once registry has been assured the device is thrust upwardly onto the sprinkler head so as to bring the tubular seat of the projection member into engagement with the extended baffle plate and this operation has the effect of returning the valve assembly to the fluid-emitting orifice.

Locking is achieved by rotating the device until the projection members of the sprinkler head flange engage biased apertures within the cavity sidewalls. These apertures are in the form of channels which extend through the sidewalls so that they are visible from an outside view. Moreover, they are positioned opposite one another and lie on a bias so as to engage the projection ends of the sprinkler head by frictional means when the device is rotated in a clockwise direction.

This locking engagement does not interfere with the ability of the sprinkler head to function in its intended manner because the device of this invention is fabricated from compositions which melt at sprinkler activating temperatures.

A conventional sprinkler will retain its shut-off valve within the fluid emitting orifice by means of a fusible composition and the sprinkler will remain in this inactive mode so long as temperatures remain at ambient levels; however, as temperatures approach critical levels the fusible composition begins to melt and the meltdown will continue until the water pressure within the conduit expels the valve from its fluid-emitting orifice.

The present device has a melting point essentially identical to that of the fusible composition so that the device becomes molten and separates from the sprinkler head at temperatures which correspond essentially to sprinkler activating temperatures.

Materials which possess this property and which are thus suitable for fabricating the present device include, for example, thermoplastic resins having a melting point of from about 100°-150° C., preferably, 105°-110° C. Typical of these are, for example, cross-linked copolymeric resins derived from styrene and arcylonitrile which melt at temperatures of about 120° C., and, also, copolymers of styrene, acrylonitrile and butadiene which exhibit a melting point range of from about 105°-115° C. Polysulfones, particularly the polyethersulfones, are also suitable as fabricating resins for the device of this invention, but the cross-linked reaction product of styrene and acrylonitrile is especially suitable and this resin constitutes a preferred fabricating material for this invention.

Other thermoplastic resins which may be employed are those derived from the copolymerization of trioxane with a minor amount of an acetyl comonomer. These resins possess carton-to-carton bonds in the polymer chains and they stabilize the polymer against various forms of degredative attack. When, for example, highly oxidative or acidic conditions are present this type of copolymer exhibits high stability and depolymerization generally stops short of the carton-to-carton link. Hydroxyethyl terminal units within the polymer chain also confer a high resistance to strongly alkaline environments. Copolymer resins which may be used to fabricate the device of this invention are those having a melting point range of from about 165°-250° C., as, for example, the resin known commercially as CELACON, a product of Celanese Engineering Resins of Chatham, N.J., which melts at about 165° C.

THE DRAWINGS

FIG. 4 is a side sectional view showing the shut-off device and sprinkler head of FIG. 1 in an engagement mode prior to locking.

FIG. 5 is a top sectional view of the shut-off device and sprinkler head shown in FIG. 4 along line 5—5.

FIG. 6 is a side sectional view showing the shut-off device and sprinkler head of FIG. 1 in a locked mode.

FIG. 7 is a top sectional view showing the shut-off device of FIG. 6 along line 7—7.

FIG. 11 is a side sectional view showing the shut-off device and sprinkler head of FIG. 8 in an engagement mode prior to locking.

FIG. 12 is a top sectional view of the shut-off device and sprinkler head shown in FIG. 11 along line 12—12.

FIG. 13 is a side sectional view showing the shut-off device and sprinkler head of FIG. 8 in a locked mode.

FIG. 14 is a top sectional view showing the shut-off device of FIG. 13 along line 14—14.

DESCRIPTION OF THE PREFERRED EMBODIMENTS

No claim of novelty is asserted for the sprinkler heads served by the present device but their construction and mode of operation are relevant to this invention and, therefore, they are discussed briefly hereinbelow.

Figure 1:
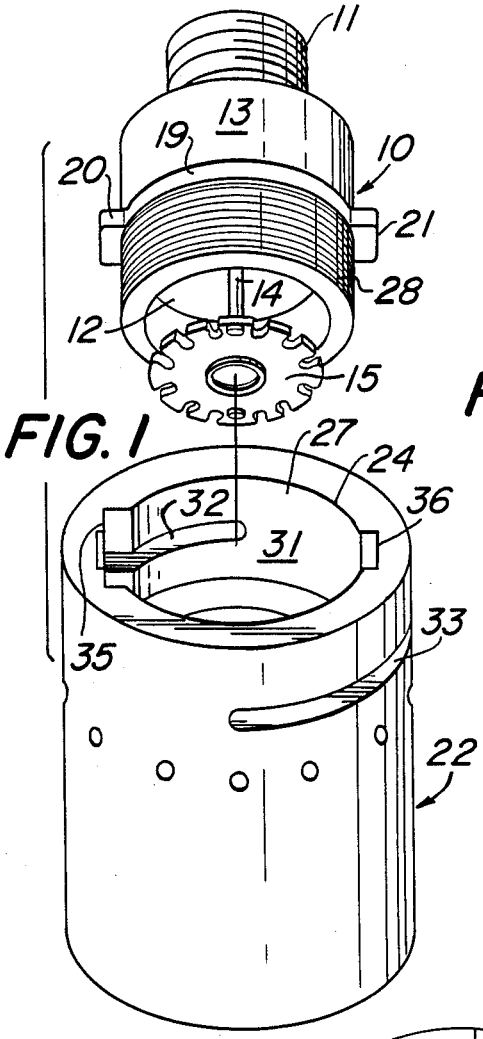
FIG. 1 is a perspective view of a shut-off device of this invention shown with a pendent-type sprinkler head.
Figure 2:
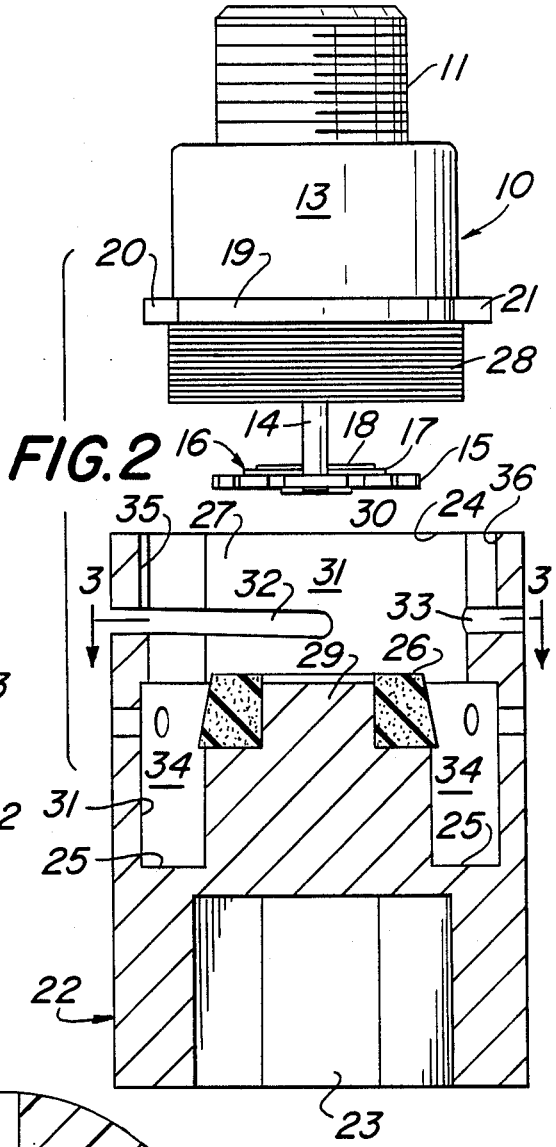
FIG. 2 is a side sectional view of the shut-off device and sprinkler head shown in FIG. 1.

Pendent-Type: In FIGS. 1-7 there is shown a pendent-type sprinkler head 10 equipped with a threaded conduit 11 for conveying fluid from an overhead water supply (not shown) through a fluid-emitting orifice 12, suspended beneath the sprinkler head housing 13 on a pair of guide rods one of which is shown as 14 in FIGS. 1 and 2 is a circular baffle plate 15 and a valve assembly 16. Said baffle plate receives the fluid emitted from orifice 12 and disperses the stream in a generally uniform pattern in finely divided form.

Figure 3:
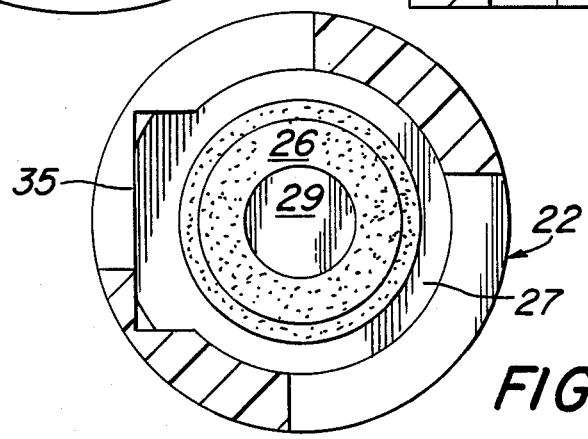
FIG. 3 is a top sectional view of the shut-off device shown in FIG. 2 along line 2—2.
Figure 8:
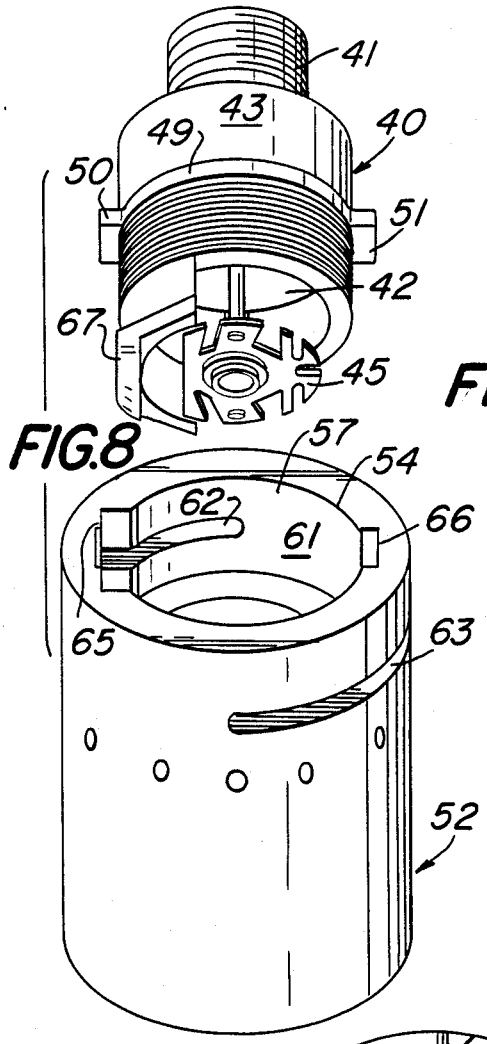
FIG. 8 is a perspective view of an alternative shutoff device according to this invention shown with a sprinkler head of the sidewall type.

In FIGS. 1-3 said guide rods are shown in a lowered position with the baffle plate 15 and valve assembly 16 in an activated or discharge mode, that is, positioned to receive the stream which flows from orifice 12, whereas, FIGS. 4-7 show the guide rods in a raised position with the baffle plate and valve assembly in a non-discharge mode.

The baffle plate 15 is serrated to distribute the stream evenly in all directions and there is secured to its topside a flat circular disc 17 upon which there is disposed a tacky film 18 for contacting the orifice 12 and obturating fluid flow when the baffle plate 15 and valve assembly 16 are in a non-discharge mode.

The shut-off device for the pendent sprinkler head 10 is shown generally as 22 in FIGS. 1-7. This device consists essentially of a hollow cylindrical body equipped at the bottom end with a hexagonal opening and at the top or opposing end with a contoured opening 24 and a cavity 27 for receiving the flange 19 of said sprinkler head and the sprinkler head housing 13. The cavity sidewalls 31 extend downwardly for about half the length of said body and terminate in a flat base 25 which extends laterally to provide the circular space or cirque shown as 34 in FIGS. 2, 4 and 6.

Centrally disposed within said cavity is a circular projection 29 which extends upwardly from the base 25 to provide a support means for a flat circular seat identified as 26 in FIGS. 2, 4 and 6.

The seat 26 is a tubular member fitted onto an accommodating segment of projection 29 for receiving baffle plate 15 and spherical segment 30 (FIG. 2) when the shutoff device 22 is impressed onto an activated sprinkler head 10.

The sidewalls 31 of the cavity 27 include opposing apertures in the form of horizontally disposed channel members 32 and 33. When viewed externally these channel members may appear identical but a careful examination reveals that they lie on a bias to the extent shown in FIG. 2 and this obliquity provides means for frictionally engaging the projection members 20 and 21 of flange 19. when the shut-off device 22 is impressed onto an activated sprinkler head 10 and rotated in a clockwise manner.

Included in the sidewalls 31 of said cavity is a horizontally disposed pattern of vent holes. An activated sprinkler head 10 emits a liquid stream under some considerable pressure and the present invention allows an installer to abate this difficulty by providing within said sidewalls a plurality of apertures through which water can be diverted and released as the device is being installed.

Operation: The sprinkler heads served by the present invention are equipped with temperature-responsive films which retain the shut-off valve within the fluid-emitting orifice by adhesive means; however, any exposure to incendiary temperatures, that is, temperatures in excess of about 105° C. will cause the adhesive to melt so that water pressure within the conduit 11 can expel the valve assembly and permit fluid to be discharged from orifice 12. The fluid thus emitted comes into contact with the baffle plate 15 and directs the liquid stream evenly to adjacent areas in the form of a finely divided spray.

The present device obturates fluid flow by returning the valve assembly 16 to the fluid-emitting orifice (FIG. 4). This shut-off stage is achieved by positioning the shut-off device 22 beneath the activated sprinkler head 10 in such manner that the cutout segments 35 and 36 are in registry with projection members 20 and 21 of flange 19 (FIGS. 1 and 2). When registry is assured the device 22 is impressed upwardly onto the sprinkler head 10 as a result of which the tubular seat 26 contacts the underside of baffle plate 15 and brings the valve assembly 16 into shut-off engagement with the fluid-emitting orifice 12 (FIGS. 4 and 5).

Locking is achieved by rotating the shut-off device 22 in a clockwise direction until projection members 20 and 21 are brought into frictional engagement with channel members 32 and 33 (FIGS. 6 and 7).

A sprinkler head 10 secured in this manner may be removed by simply rotating the shut-off device in a counterclockwise direction. Alternatively, the shut-off device 22 may be left unattended without risk because it is fabricated from compositions which melt at incendiary temperatures. Accordingly, any rise in temperature to critical levels, that is, temperatures in excess of about 105° C. will cause the shut-off device 22 to lose its hold and automatically return the sprinkler head to an activated mode.

Sidewall Type: FIGS. 8–14 illustrate a shut-off device 52 for a sprinkler head of the sidewall type 40. This sidewall sprinkler 40 is essentially identical in operation to the pendent-type sprinkler shown as 10 in FIGS. 1–7 except that the baffle plate 45 consists essentially of projecting fingers, guide rod 44 and a vertically disposed arcuate deflector 65 for directing water in a given direction.

The shut-off device which serves this sidewall sprinkler head 40 is the hollow cylindrical body shown generally as 52 in FIGS. 8–14. This device is characterized by a hexagonal orifice 53 at one end and includes at the opposite end a contoured circular orifice 54 for receiving the projecting members 50 and 51 of flange 49.

Figure 9:
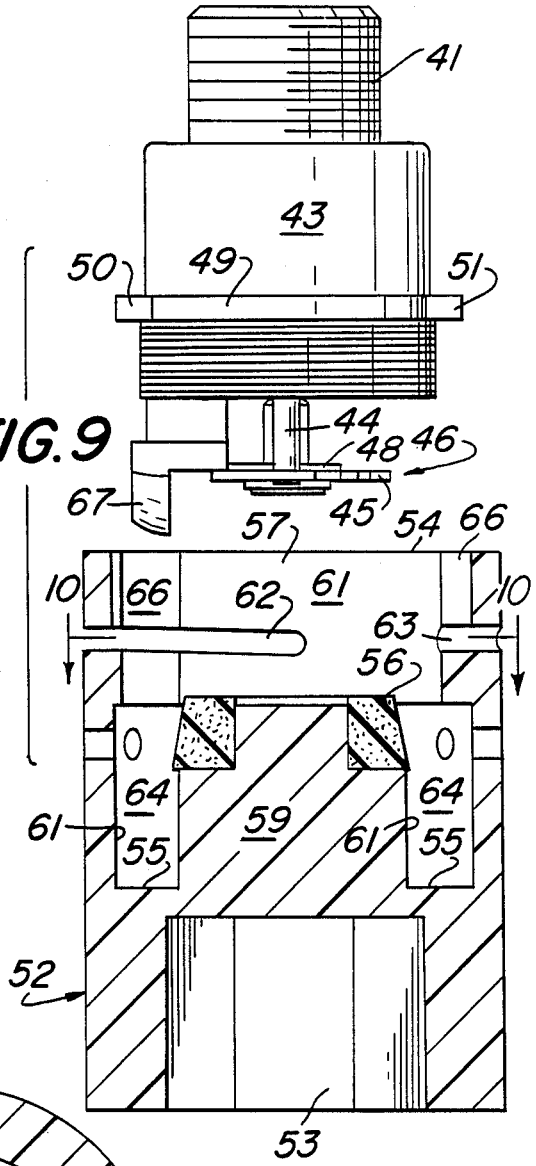
FIG. 9 is a side sectional view of the shut-off device and sprinkler head shown in FIG. 8.
Figure 10:
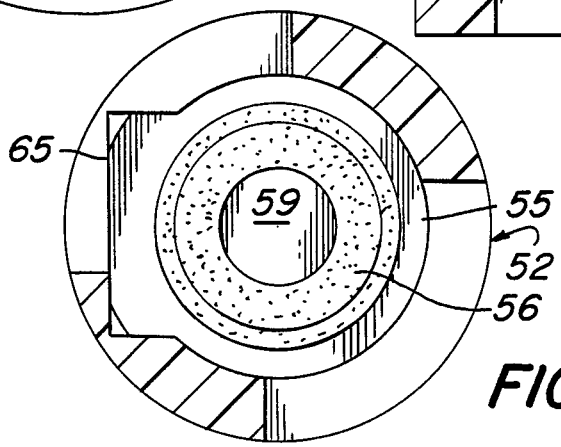
FIG. 10 is a top sectional view of the shut-off device shown in FIG. 9 along line 10—10.

Extending downwardly from orifice 54 is a cavity 57 defined by downwardly extending sidewalls 61 and the flat laterally extending base shown as 55 in FIGS. 9, 11 and 13.

Centrally disposed within said cavity and extending upwardly from the base 55 is a circular projection 59 which terminates in a flat support upon which there is secured the tubular seat identified as 56 in FIGS. 9–11 and 13. The upwardly projecting member 59 is centrally disposed within the cavity 57 so that its sidewalls and the cavity sidewalls 61 combine to form a circular space or cirque 64 for receiving the deflector 67 of the sprinkler head 40 when the shut-off device is impressed onto an activated sprinkler head.

Included within the sidewalls of cavity 57 are apertures in the form of horizontally disposed channel members 62 and 63 which extend through the walls of the shut-off device 52. These channel members are obliquely biased to provide means for frictionally engaging the projection members 50 and 51 of flange 49 when the shut-off device 52 is impressed onto an activated sprinkler head 40 and rotated in a clockwise direction. In FIG. 9 only the obliquity of channel member 62 can be seen in the drawings but channel member 63 is identically disposed.

Operation: The shut-off device 52 is installed by aligning its cutout segments 65 and 66 with the projection members 51 and 51 of the sprinkler head flange 49 and impressing the former upwardly with a thrusting force greater than the pressure exerted by the liquid stream emitted from orifice 42. The plurality of holes within the sidewalls of the device 52 provide a form of pressure release by allowing water entrapped within the cavity 57 to escape and thus facilitate the installation procedure.

The upward thrust of the shut-off device 52 onto the sprinkler head 40 brings the underside of baffle plate 45 into engagement with tubular seat 56 and causes the valve assembly 46 and film 48 to engage the fluid emitting orifice 52 where it creates a seal against further fluid discharge. At this juncture the projection members 50 and 51 are in view and can be clearly seen through channel members 62.

Once the shut-off device has been installed and the flow of liquid has been stanched the sprinkler head 40 is secured against inadvertent discharge by turning said device in a clockwise direction so as to bring projection members 50 and 51 of flange 49 into engagement with the biased segment of the channel members 62 and 63 (FIGS. 13 and 14).

A sprinkler head secured in this manner can be reactivated by rotating the shut-off device 52 in a counterclockwise direction and withdrawing same in a downward fashion. Alternatively, the shut-off device 52 can be allowed to remain on the sprinkler head without jeopardy because the device is fabricated from thermoplastic compositions which melt at sprinkler activating temperatures so that in case of a fire emergency the shut-off device 52 will simply melt, separate and return the sprinkler head to an operable mode.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. A device for terminating fluid flow in a temperature-activated sprinkler head comprised of a water conduit, a bifurcated flange, circular housing, baffle plate and cutoff valve which comprises:

(1) a cylindrical hollow body having at one end a contoured orifice for receiving a bifurcated flange of generally circular configuration said body consisting essentially of a thermoplastic composition which melts at sprinkler-activating temperatures;

(2) a cavity formed by the inner sidewalls of said body which extend downwardly from said orifice and terminate in a flat laterally extending base so as to form a recess area for receiving said bifurcated flange, housing, baffle plate and valve assembly;

(3) a circular projection centrally disposed within said cavity and extending upwardly from said base to provide a support surface upon which is secured a flat tubular seat for receiving said baffle plate; and (4) apertures within said body for engaging said flange.

2. The device according to claim 1 wherein said apertures are oppositely disposed.

3. The device according to claim 2 wherein said apertures are in the form of horizontally disposed channels.

4. The device according to claim 3 wherein said channel members are biased and engage the projection members of said flange by frictional means.

5. The device according to claim 1 wherein said thermoplastic composition is a resin having a melting point of from about 100°-250° C.

6. The device according to claim 5 wherein said resin is a cross-linked copolymer having a melting point of from about 105°-120° C.

7. The device according to claim 6 wherein said resin is a copolymer derived from styrene and acrylonitrile.

8. The device according to claim 1 wherein said projection extends upwardly from the base of said cavity for about half the distance to said orifice.

9. A device for terminating fluid flow in a temperature-activated sprinkler head comprised of a water conduit, a bifurcated flange, circular housing, baffle plate and cut-off valve which comprises:

(1) a cylindrical hollow body having at one end a contoured orifice for receiving a bifurcated flange of generally circular configuration said body consisting essentially of a thermoplastic composition which melts at sprinkler-activating temperatures;

(2) a cavity formed by the inner sidewalls of said body which extends downwardly from said orifice and terminate in a flat laterally extending base so as to form a recess area for receiveing said bifurcated flange, housing, baffle plate and valve assembly, said sidewalls including a series of holes which provide a release means for the escape of water entrapped within said cavity;

(3) a circular projection centrally disposed within said cavity and extending upwardly from said base to provide a support surface upon which is secured a flat tubular seat for receiving said baffle plate; and (4) apertures within said body for engaging said flange.

* * * * *